US006450715B2

(12) United States Patent
Ohba

(10) Patent No.: US 6,450,715 B2
(45) Date of Patent: Sep. 17, 2002

(54) CARTRIDGE TYPE CONTAINER FOR FEEDING A STICK TYPE COSMETIC MATERIAL

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/858,663

(22) Filed: May 17, 2001

(30) Foreign Application Priority Data

May 18, 2000 (JP) ..... 2000-146217

(51) Int. Cl.[7] ..... A45D 40/04
(52) U.S. Cl. ..... 401/78; 401/68
(58) Field of Search ..... 401/68, 78, 62, 401/73, 99, 116

(56) References Cited

U.S. PATENT DOCUMENTS 3,106,908 A * 10/1963 Gretz ..... 401/62
4,997,299 A * 3/1991 Ohba ..... 401/75
5,336,005 A * 8/1994 Moeck et al. ..... 401/68
5,879,093 A * 3/1999 Ohba et al. ..... 401/68
5,884,638 A * 3/1999 Ohba ..... 401/62
6,293,719 B1 * 9/2001 Ohba ..... 401/59
6,334,729 B1 * 1/2002 Ohba ..... 401/68

FOREIGN PATENT DOCUMENTS

JP 5-13307 2/1993
JP 2524360 11/1996

* cited by examiner

*Primary Examiner*—Charles R. Eloshway
(74) *Attorney, Agent, or Firm*—Rabin & Berdo

(57) ABSTRACT

A push rod 50 is provided in a container body 4 and a cartridge 2 is attached to the container body 4 in such a manner that the cartridge 2 can be attached and detached. Due to rotations of the container body 4 and the cartridge 2, a feeding mechanism causes the push rod 50 in the container body 4 to spirally advance, pushes a core chuck member 20 in the cartridge 2, and causes a stick type cosmetic material retained at the core chuck member 20 to move forward and backward. The core chuck member 20 is always urged in a direction of retreat by a spring 3, and when the cartridge 2 is attached to the container body 4, the push rod 50 is pushed back by repulsion to an inside of the container body 4 so as to prevent the stick type cosmetic material from projecting out of the cartridge 2.

7 Claims, 11 Drawing Sheets

CARTRIDGE TYPE CONTAINER FOR FEEDING A STICK TYPE COSMETIC MATERIAL

BACKGROUND OF THE INVENTION

1. Field of the Invention

The present invention relates to a cartridge type container for feeding a stick type cosmetic material, and particularly to a feeding container which produces an effect equal to that of a mechanism that uses a spring for automatically returning a push rod in a container body.

2. Description of the Related Art

Conventional cartridge type containers for feeding a stick type cosmetic material retain the stick type cosmetic material in a cartridge using a core chuck. These conventional containers are composed of the cartridge, and always urge the core chuck in a direction of retreat using a spring or the like. These conventional containers further include a container body having a push rod inserted therein. Various kinds of cartridge type containers for feeding a stick type cosmetic material, which advance a rear end of the core chuck in the cartridge against the urging force of the spring due to a movement of the push rod in an axial direction, are actually being sold by various manufacturers.

Heretofore, after feeding out the push rod in the container body and using up the stick type cosmetic material, the user had to inversely rotate the cartridge and the container body and feed down the push rod in the container body up to the retreat limit before the cartridge was drawn out of the container body. Otherwise, when a new cartridge was then attached to the container body, the core chuck of the cartridge was pushed by the push rod located at the uppermost limit and the stick type cosmetic material was abruptly fed out up to the stroke limit, thereby causing the core to break or chip.

A cartridge type feeding container is known for feeding a stick type cosmetic material, in which the inconvenience described above is improved. This container has an automatic return mechanism of a push rod in which the push rod in a container body is always automatically returned to the retreat limit due to an urging force of a spring in a direction of retreat. The push rod in the container body will always return to the retreat limit if a user merely draws the cartridge out of the container body, whereby the stick type cosmetic in the cartridge will never be imprudently fed out when the cartridge is newly attached to the container body. Thus, this container has an extremely specific effect.

Further, since the push rod is always urged in a direction of retreat due to the spring, the more the spring shrinks, the more force to race the cartridge is applied due to an advance of the push rod. Thus, it is easy to bring about a phenomenon in which the push rod is freely pulled in. Under the circumference, a mechanism, for preventing the racing, provides a frictional resistance member between the container body and the cartridge, such as disclosed in Japanese Utility Model Registration No. 2524360.

In other words, an automatic return mechanism of the push rod in the container body of the cartridge type container for feeding a stick type cosmetic material can be realized by a combination of Japanese Utility Model Publication No. Hei 5-13307 and Japanese Utility Model Registration No. 2524360 described above.

The present invention realizes an effect equal to that of the automatic return mechanism of the push rod in the container body without using a spring for urging the push rod in the container body in a direction of retreat. Also, the present invention is directed to provide a cartridge type container for feeding a stick type cosmetic material which is not costly, but simple and functional.

SUMMARY OF THE INVENTION

In order to achieve the object mentioned above, a cartridge type container for feeding a stick type cosmetic material according to the present invention comprises a container body provided with a container body member, and a push rod which is installed in the container body in such a manner that the push rod is not urged forward or backward. A cartridge can be attached to a front end of the container body in such a manner that the cartridge can freely be attached and detached. The cartridge has an exposed section which is not housed in the container body when the cartridge is attached to the container body. A core chuck member slides in the cartridge and retains the stick type cosmetic material. A spring urges the core chuck member in a direction that the stick type cosmetic material retreats. A feeding mechanism is formed in a state that the cartridge is attached to the container body and causes the push rod to move forward and backward by spiral engagement due to relative rotations of the exposed section of the cartridge and the container body member, wherein when the cartridge is attached to the container body, until the feeding mechanism is formed, the push rod can move in a direction of retreat in the container body by pushing a tip of the push rod on the side of a rear end surface of the core chuck member which is always urged backward by the spring in the cartridge.

In the present invention, when the cartridge is attached to the container body, by pushing a front end of the push rod in the container body by a rear end surface of the core chuck member which is always urged backward by a spring in the cartridge, the push rod is caused to retreat until the feeding mechanism is formed. And when the cartridge is completely attached to the container body, the feeding mechanism for causing the push rod to advance and retreat is formed, thereby enabling the push rod to move in an axial direction.

Thus, in the present invention, when the cartridge is inserted into the container body, a rear end surface of the core chuck member which is a rear end section of the cartridge pushes the push rod, whereby the push rod retreats to near the retreat limit. Further, when the cartridge is inserted up to the end and is attached to the container body, the feeding mechanism for causing the push rod to advance and retreat is formed. Thus, even in such a condition that the push rod in the container body is fed out for some reasons, when a new cartridge is attached, the push rod is pushed back to near the retreat limit by the core chuck without rotation regulating mechanism's establishment, whereby it is possible to prevent an accident, such as dirt or stain, which may occur resulting from inadvertently feeding out the stick type cosmetic material from the cartridge.

DESCRIPTION OF THE PREFERRED EMBODIMENTS

Figure 1:
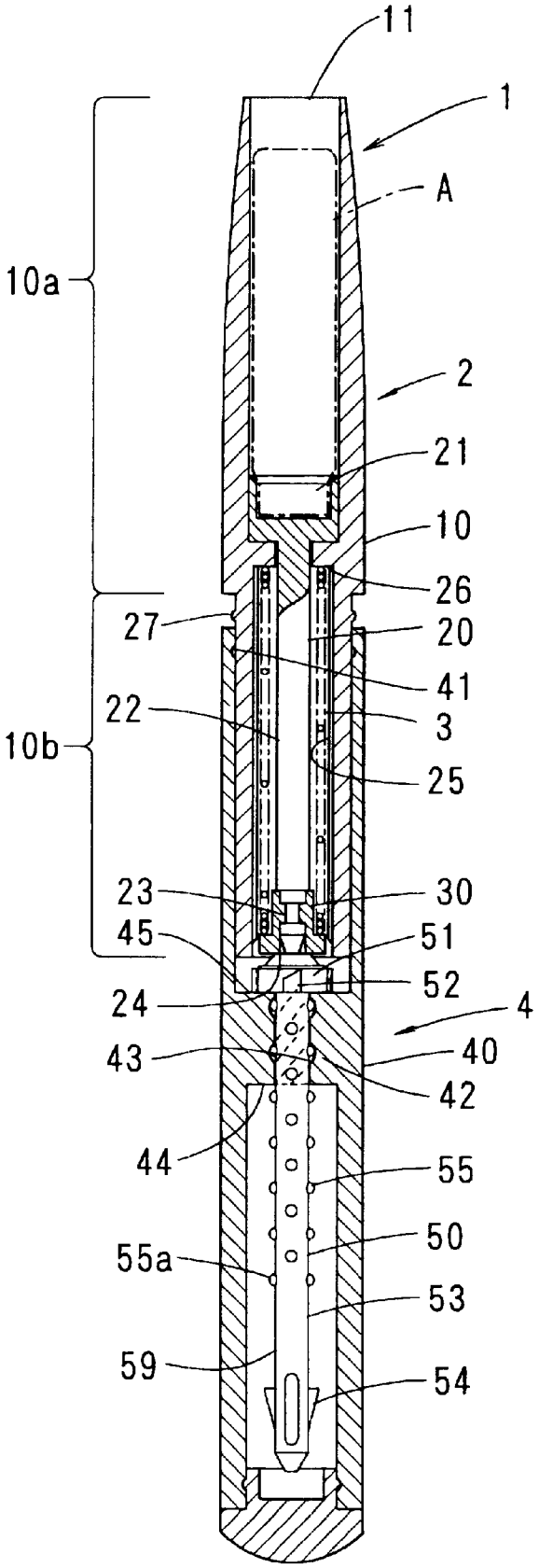
FIG. 1 is a longitudinal sectional view showing a first embodiment of the present invention.

FIG. 1 is a partially longitudinal sectional view of a cartridge type container for feeding a stick type cosmetic material 1 according to a first embodiment of the present invention and shows a state that a cartridge 2 has not completely been attached to a container body 4 yet. The cartridge 2 is composed of a front cylinder 10, a core chuck member 20, a compression coil spring 3, and a stopper member 30. The front cylinder 10 is composed of an exposed section 10*a* to be used as a holding section and a rotary section 10*b* which is a part to be inserted into the container body 4. Further, a cosmetic material retaining section 21 of the core chuck member 20 slides in exposed section 10*a*. A step section 26 forms a boundary between the exposed section 10*a* and the rotary section 10*b*. A rod 22 extends from the cosmetic material retaining section 21 and is disposed in the rotary section 10*b*. The stopper member 30 is fixed to a rear part of the rod 22 using a concave section 23. The spring 3 is disposed between a lower end surface of the step section 26 and the stopper member 30. The spring 3 urges the core chuck member 20 backward.

A synchronous engagement section 52 is provided at a front end of a push rod 50 inside the container body 4. The synchronous engagement section 52 engages an engagement line section 25 that is at an inside diameter of the rotary section 10*b*, to form a rotation regulating mechanism.

The container body 4 has at its front section an annular concave section 41 which is engaged with an engagement projection 27 of the cartridge 2 and rotatably retains the cartridge 2. A female screw section 42 is formed inside the container body 4. A spiral groove 43 of the female screw section 42 is spirally engaged with a male screw section 55 of the push rod 50. The male screw section 55 is composed of a plurality of projections disposed in an axial direction of the push rod 50 which collective form at least one helical thread, thereby constituting a spiral engagement mechanism.

As will be appreciated, resistance due to friction will occur between the spiral groove and the projections when the push rod 50 is pushed by a rear end of the core chuck member 20 and moved backward. This resistance can easily be controlled by setting a lead angle of the spiral groove 43 of the female screw section 42. By setting an appropriate lead angle, and thus the resistance, it thus becomes possible to smoothly feed down the push rod 50 along the female screw section 42 simply by pushing an upper part of the push rod 50.

Further, a large diameter section 51 at a front part of the push rod 50 forms the synchronous engagement section 52 to be engaged with the cartridge 2. A lower end of the large diameter section 51 comes into contact with an upper end surface 45 of the female screw section 42, to define a retreat limit of the push rod 50.

A pair of bend pieces 54 are installed at a rear part of the push rod 50 according to the first embodiment. The bend pieces 54 springback to their original shape after passing through the female screw section 42 of the container body member 40 during the installation process, to form a coming-off stop. Therefore, the container body 4 can be made from two members, namely, the container body member 40 and the push rod 50.

Figure 2:
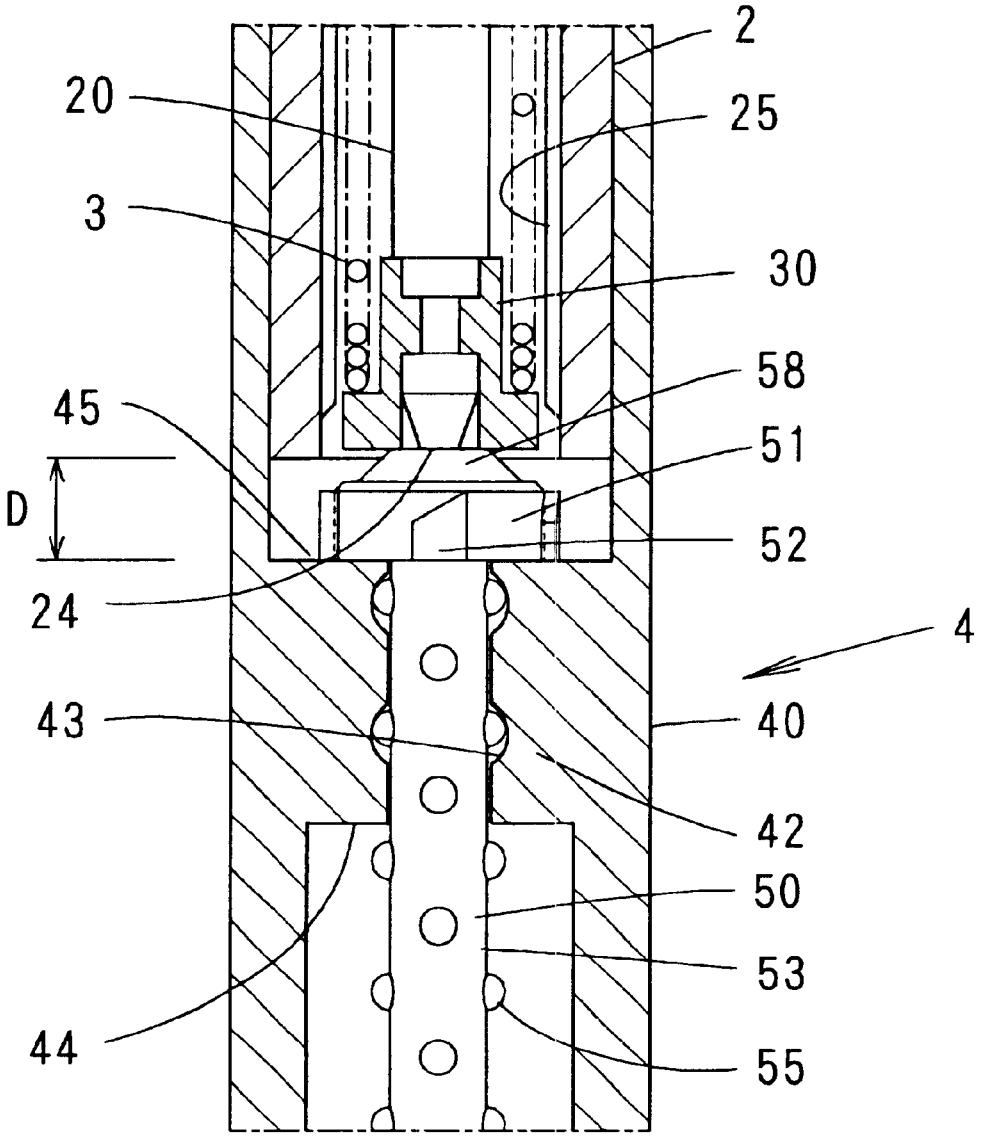
FIG. 2 is a longitudinal sectional view of an enlarged part of FIG. 1.

FIG. 2 is an enlarged view showing a state of contact between the large diameter section 51 at a tip of the push rod 50 with a rear end surface 24 of the core chuck member 20 which is a rear end section of the cartridge 2, right before the complete installation of the cartridge 2 onto the container body 4.

In order to have an automatic return, without using a spring, when the cartridge 2 is inserted into the container body 4, the rear end surface 24 of the core chuck member 20 comes into contact with a tip of a convex section 58 of the large diameter section 51, no matter where the push rod 50 is positioned in the container body 4. This causes the push rod 50 to be pushed back in a direction of the retreat limit. Moreover, the spring force prevents the.

A lead angle of the male screw section 55 and the female screw section 42 of the container body member 40 is set so that frictional resistance allows the push rod 50 to be pushed down only by pushing the upper part of the push rod 50. Moreover, due to a resiliency of the spring 3, the push rod 50 is easily pushed to a position shown in FIG. 2, namely, the retreat limit of the push rod 50, where a lower end of the large diameter section 51 of the push rod 50 comes into contact with the upper end surface 45 of the female screw section 42.

Further, when the cartridge 2 is pushed into the container body 4 and the engagement projection 27 of the cartridge 2 fits in the annular concave section 41 provided at a front part of the container body member 40, the core chuck member 20 in the cartridge 2 is pushed by push rod 50 by a length of a front end fit-in dimension D of the push rod 50. As a result, as shown in FIG. 3, the engagement line section 25 in the cartridge 2 engages with the synchronous engagement section 52 provided at an outer circumference of the large diameter section 51 at a tip of the push rod 50, whereby a rotation regulating mechanism is constituted and at the same time a feeding mechanism is formed.

Figure 3:
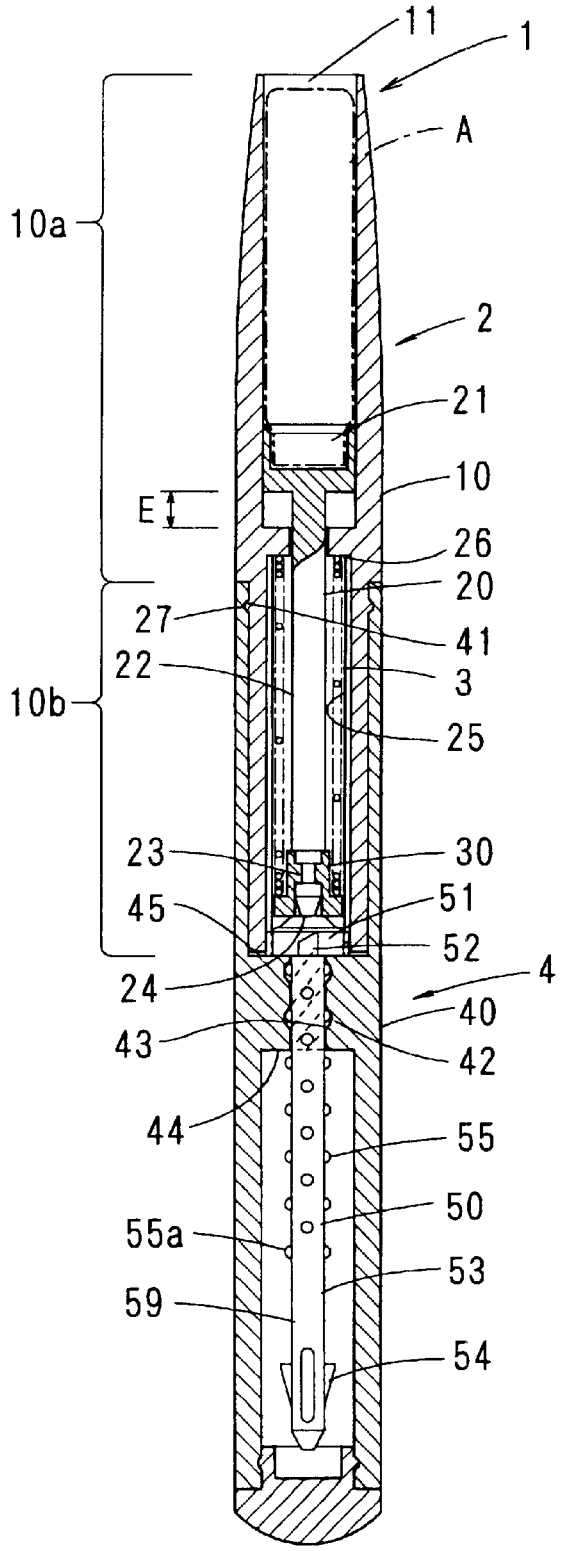
FIG. 3 is a longitudinal sectional view showing a state that a feeding mechanism according to the first embodiment of the present invention is formed.

FIG. 3 is a longitudinal sectional view showing the cartridge 2 being completely fitted in the container body 4. Corresponding to the dimension D described above, a rear end surface of the cosmetic material retaining section 21 of the core chuck member 20 is pushed up by a dimension E. In other words, a stick type cosmetic material A advances upward inside the cartridge 2 by the dimension E, which is almost equivalent to the dimension D.

Next, the operating conditions will be described. When the exposed section 10*a* of the cartridge 2 is rotated relative to the container body member 40, since the male screw section 55 is spirally engaged with the female screw section 42, and the engagement line section 25 of the cartridge 2 is engaged by a spline with the synchronous engagement section 52, the push rod 50 will be rotated synchronously with the exposed section 10*a*.

Further, the female screw section 42 will be rotated relatively to the push rod 50. Therefore, due to the spiral engagement between the spiral groove 43 and the male screw section 55, the push rod 50 will start to move in an axial direction. Thus, the rear end surface 24 of the core chuck member 20 will be pushed by a tip section of the push rod 50, so that the core chuck member 20 will begin moving while the compression coil spring 3 is shrunk. Therefore, the stick type cosmetic material A, whose tail section is retained by the cosmetic material retaining section 2, will be moved to project from a front end opening hole 11 of the cartridge 2.

Figure 4:
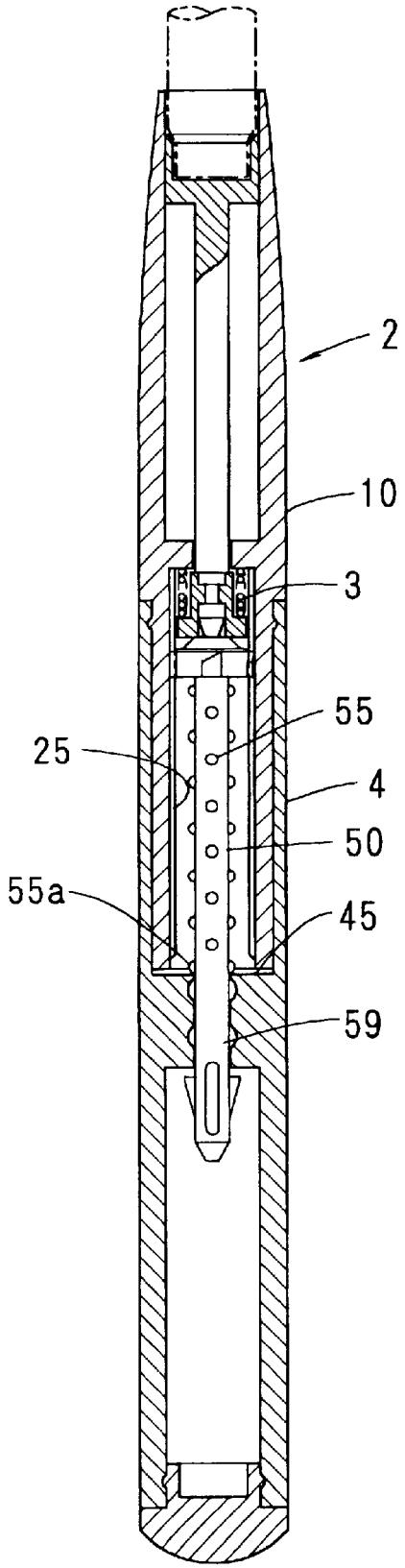
FIG. 4 is a longitudinal sectional view showing a state of the uppermost limit according to the first embodiment of the present invention.

FIG. 4 shows the uppermost limit of the push rod 50. If the exposed section 10*a* continues to be rotated relative to the container body member 40 in a feeding direction, the push rod 50 will be fed up to the point where a tail end projection 55*a* formed at the shaft 53 passes through the female screw section 42.

However, even though the rotation is continued, the spiral engagement mechanism will ceases to function, due to the absence of projections in a non-projection section 59 of the push rod 50. Thus, the feeding uppermost limit is defined when the tail end projection 55*a* falls into a next spiral of the spiral groove 43 of the female screw section 42, resulting in the sound of ticktack, due to urging force of the spring 3 in the cartridge 2. Due to this clutch mechanism, the user is notified of the uppermost limit of the stick type cosmetic material. Thus, it is possible to prevent damage which may occur resulting from excessive stress applied to internal members.

Further, in this state, which is normally a state in which the stick type cosmetic material has been used up, the cartridge 2 is pulled out of the container body 4.

Then, when a new cartridge 2 is inserted, the push rod 50 will be pushed back to the retreat limit by the rear end surface 24 of the core chuck member 20, which is a rear end section of the new cartridge 2.

Heretofore, the push rod was caused to be automatically returned by the spring which always urged the push rod backward, whereby an accident, such as breaking which may occur resulting from inadvertent feeding of the stick type cosmetic material at the time of inserting the cartridge, is prevented from arising. However, the present invention can provide a cartridge type container for feeding a stick type cosmetic material which is capable of preventing such an accident from arising without using the spring in the container body.

More specifically, the first embodiment adopts means for pushing the male screw section 55 of the push rod 50 while rotating the push rod 50 along the female screw section 42 utilizing a resiliency of the spring 3. The pushing is performed by a rear end section of the cartridge, such as the rear end surface 24 of the core chuck member 20. It is thus possible to bring about a result equal to the result attained by compulsively urging the push rod 50 backward using only a spring. In other words, the first embodiment realizes a function of preventing the stick type cosmetic material A from inadvertently projecting from the front end opening hole 11 when a new cartridge 2 is installed.

Further, it is not necessary to make the resiliency of the spring 3 excessively strong and it is also possible to make do with the resiliency of the spring which urges the conventional core chuck member backward.

Further, the first embodiment is characterized in that the rotation regulating mechanism is formed by a spline connection of the cartridge 2 and the push rod 50 at the same time when the cartridge 2 is rotatably attached to the container body 4. By providing a convex section 58 at a tip of the push rod 50 as clearly shown in FIG. 2, there is provided a space for not allowing the formation of the rotation regulating mechanism in which the engagement line section 25 in the cartridge 2 is synchronously engaged with the synchronous engagement section 52 provided at an outer circumference of the large diameter section 51 of the push rod 50 when the cartridge 2 pushes the push rod 50.

FIGS. 5 through 10 show a second embodiment of the present invention.

Figure 5:
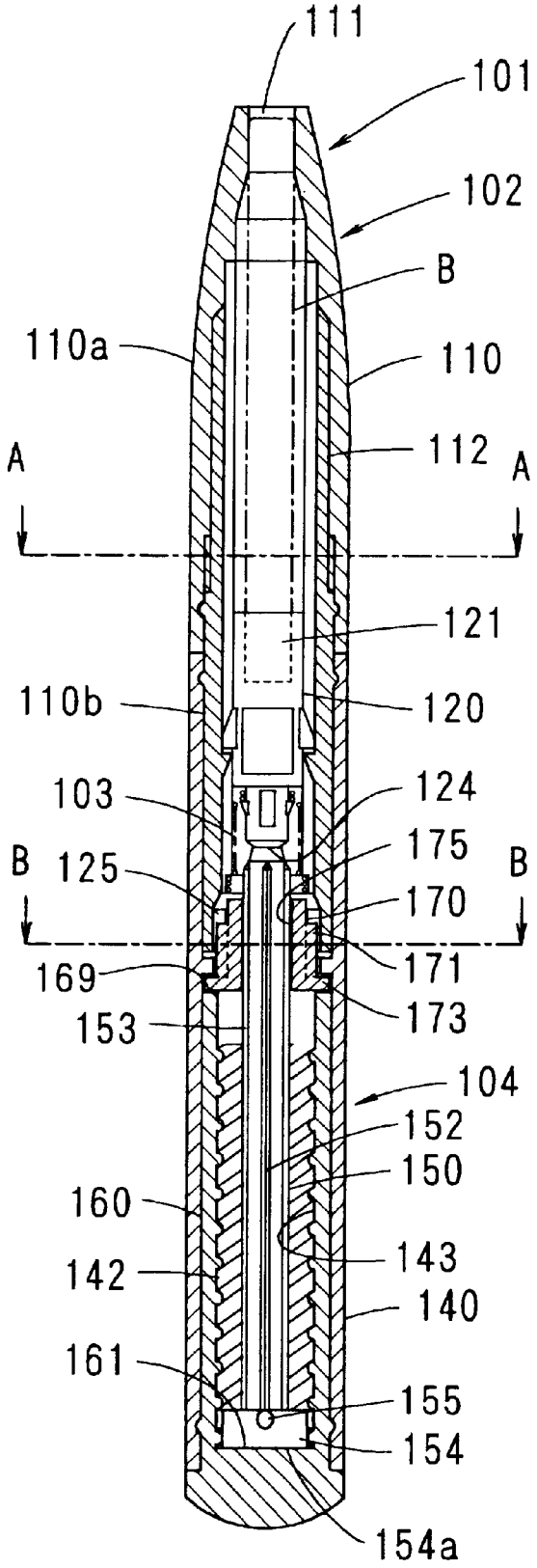
FIG. 5 is a longitudinal sectional view showing a state that a feeding mechanism according to a second embodiment of the present invention is formed.
Figure 6:
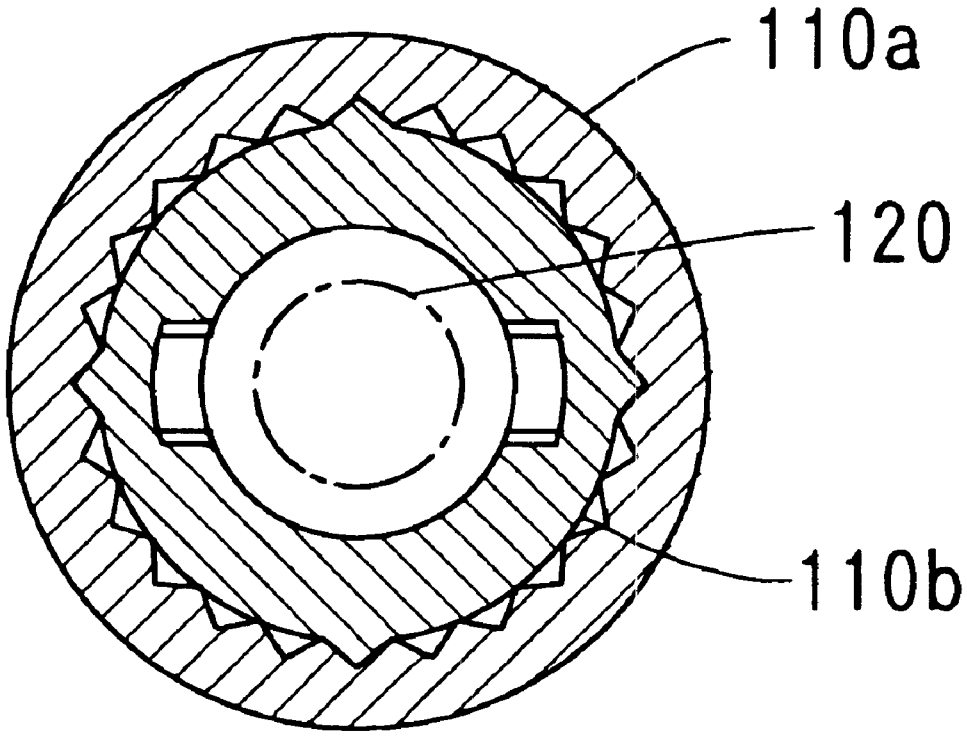
FIG. 6 is a sectional view taken along line A—A of FIG. 5.
Figure 7:
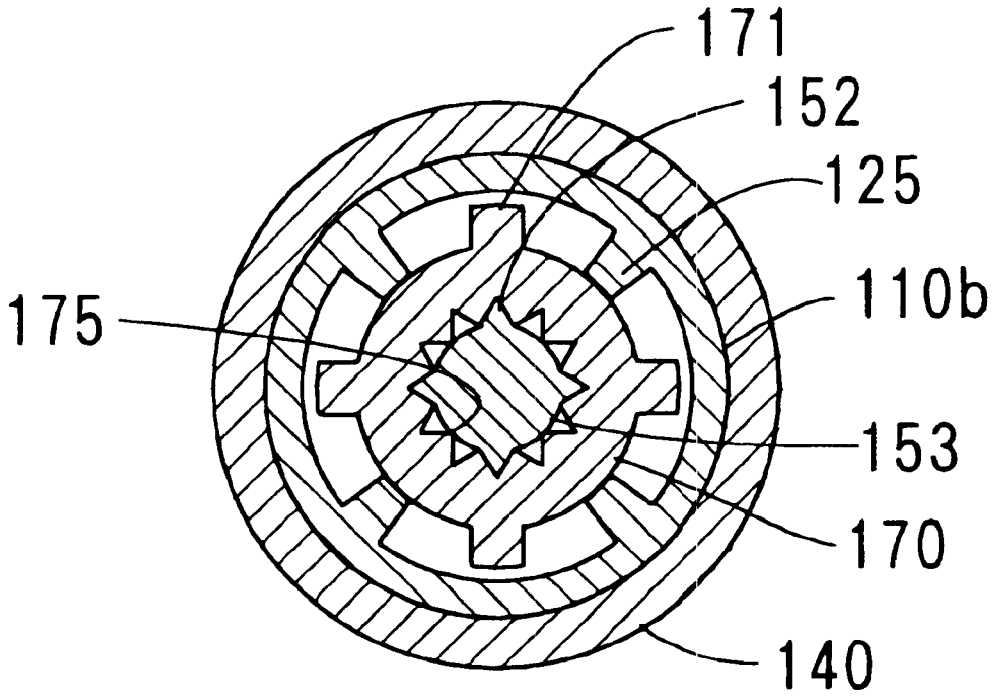
FIG. 7 is a sectional view taken along line B—B of FIG. 5.

FIG. 5 is a longitudinal sectional view showing a cartridge type container for feeding a stick type cosmetic material 101.

A cartridge 102 is composed of a front cylinder 110, an internal cylinder 112 unrotatably fixed to the front cylinder 110, a core chuck member 120, and a spring 103 which is a helical tension spring or the like. An outward frame of the cartridge 102 is formed by an exposed section 110*a* which is exposed when the cartridge 102 is attached to a container body 104. A rotary section 110*b* of the internal cylinder 112, which is inserted when the cartridge 102, is attached to the container body 104.

Further, a stick type cosmetic material B is retained at the core chuck member 120 and is always urged backward by the spring 103, which is a helical tension spring.

In the container body 104, an internal cylinder spiral member 160 is inserted from a rear end of a container body member 140 and fixed. The container body member 140 and the internal cylinder spiral member 160 are synchronously rotated.

On the other hand, a male screw section 155 is formed at an outward frame of a flange section 154 at a rear end of a push rod 150. Further, from the flange section 154, a synchronous engagement section 152 constituted by a non-circular shaft 153 is provided. The synchronous engagement section 152 goes through a rotation regulating member 170 which will be described hereinafter.

Thus, the second embodiment is characterized in that the rotation regulating member 170 is used for a part which constitutes a rotation regulating mechanism of the push rod 150.

The synchronous engagement section 152 formed in the form of a vertical rib at an outer circumference of the push rod 150 is engaged with an engagement line section 175 provided on an inner circumferential surface of the rotation regulating member 170 in such a manner that the synchronous engagement section 152 cannot rotate, but can slide, and the synchronous engagement section 152 goes through the engagement line section 175.

Further, a vertical rib 171 installed at an outer circumference of the rotation regulating member 170 is synchronously engaged with a spline 125 at an inside diameter of the cartridge 102, whereby the exposed section 110*a* of the cartridge 102 and the rotation regulating member 170 synchronously rotate.

In other words, the second embodiment is characterized in that the rotation regulating member 170 is also a component of a rotation regulating mechanism for regulating rotations of the cartridge 102 and the push rod 150.

A flange section 173 is provided at the rotation regulating member 170. The flange section 173 loosely fits in between an upper end surface 169 of the internal cylinder spiral member 160 and a lower end surface 148 of a convex step section 149 provided on an inner circumferential surface of the container body member 140. Thus, the rotation regulating member 170 is prevented from coming off the front end opening hole of the container body 104, for example, when the container body member 104 is turned upside down.

Further, a female screw section 142 having a stroke length is provided at an inner circumference of the internal cylinder spiral member 160. A spiral groove 143 formed at the female screw section 142, and the male screw section 155 of the flange section 154 at a rear end of the push rod 150 constitute the spiral engagement mechanism by their spiral engagement. Further, a lead angle of a spiral in the spiral engagement is in accordance with the first embodiment. Also, it is justifiable to arrange such that the push rod 150 naturally falls by a dead load in the spiral groove 143 of the internal cylinder spiral member 160 while rotating.

The retreat limit of the push rod 150 in the second embodiment is defined when a rear end surface 154*a* of the flange section 154 comes into contact with a bottom surface 161 of the internal cylinder spiral member 160.

Operation will be described with reference to FIG. 5. When the exposed section 110*a* of the cartridge 102 is rotated with respect to the container body member 140, the rotation regulating mechanism of the push rod 150 constituted also by the rotation regulating member 170 functions and the front cylinder 110 of the cartridge 102 and the push rod 150 are synchronously rotated. On the side of the container body 104, the feeding mechanism then functions due to the spiral engagement mechanism in which the male screw section 155 at an outer circumference of the flange section 154 provided at a rear end of the push rod 150 is spirally engaged with the spiral groove 143 of the female screw section 142 of the internal cylinder spiral member 160 fixed to the container body member 140. Thus, the push rod 150 starts moving in an axial direction while rotating synchronously with the cartridge 102, and by pushing a rear end surface of the core chuck member 120 in the cartridge 102 against the spring 103, the stick type cosmetic material B starts projecting from a front end opening hole 111 of the cartridge 102.

Figure 8:
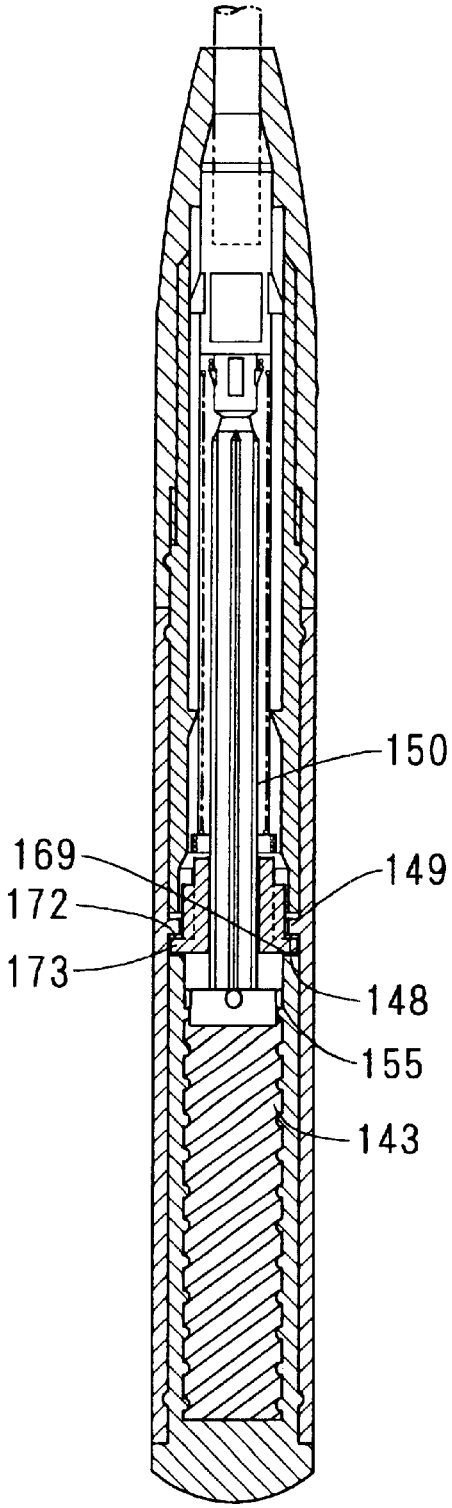
FIG. 8 is a longitudinal sectional view showing a state of the uppermost limit according to the second embodiment.

Further, if the rotation is continued, the male screw section 155 formed at the flange section 154 of the push rod 150 gets out of the spiral groove 143 of the internal cylinder spiral member 160 as shown in FIG. 8. On the other hand, since the push rod 150 is always urged backward by the urging force of the spring 103 of the cartridge 102, if the rotation is further continued, every time the rotation is made, the male screw section 155 of the flange section 154 of the push rod 150 will fall in the spiral groove 143 of the internal cylinder spiral member 160 and will make a ticktack sound, thereby notifying the user of the feeding uppermost limit of the push rod 150.

Figure 9:
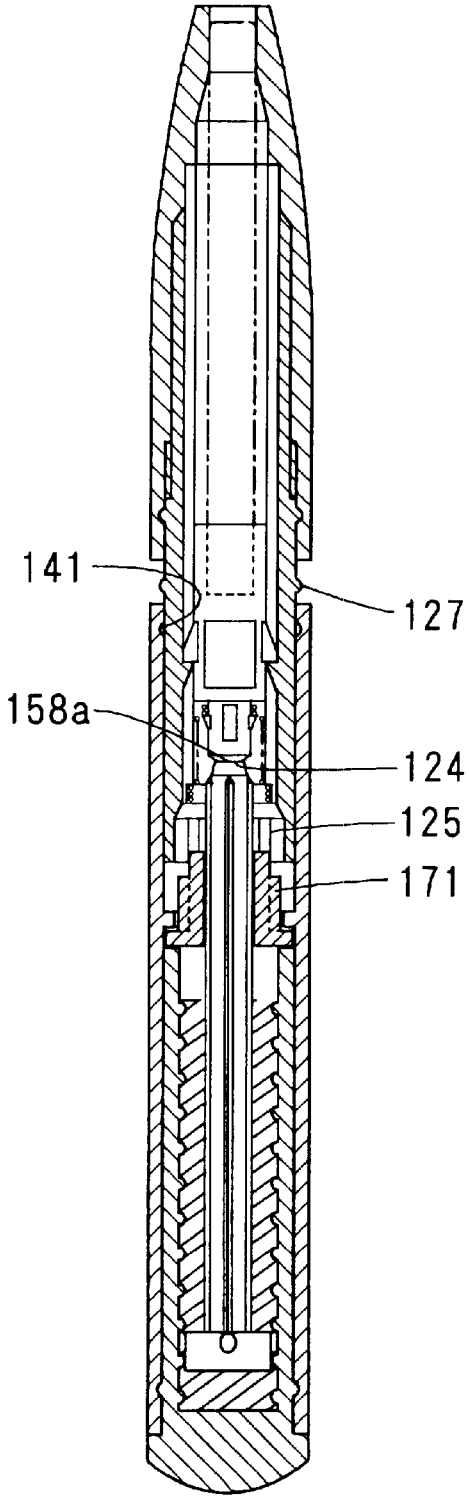
FIG. 9 is a longitudinal sectional view of the second embodiment.

In the ordinary use, a state which the stick type cosmetic material B has been used up is a state which the push rod 150 is at the feeding uppermost limit. In this state, the cartridge 102 is pulled out of the container body 104. As shown in FIG. 9, when the rotation regulating mechanism which is constituted by the synchronous engagement section 152 of the push rod 150, the rotation regulating member 170, and the spline 125 provided on an inner circumferential surface of the cartridge 102 is released, the helical tension spring 103 in the cartridge 102 pulls back the core chuck member 120 in a direction of the retreat limit. At this time, while rotating synchronously with the rotation regulating member 170, the push rod 150 is automatically pulled back in a direction of the retreat limit along the spiral groove 143 of the internal cylinder spiral member 160.

Further, when a new cartridge 102 is attached to the container body 104, even though the push rod 150 has not fallen down to the retreat limit, a rear end surface 124 of the core chuck member 120 urged by the spring 103 which is a rear end section of the cartridge 102 pushes a front end surface of the push rod 150 and the front end surface is pushed down to a position near the retreat limit which is a contact surface of the rear end surface 154*a* of the flange section 154 of the push rod 150 and the bottom surface 161 of the internal cylinder spiral member 160. Further, the push rod 150 is pushed down by human power and an engagement projection 127 which is an outside frame of the cartridge 102 is retained at an annular concave section 141 provided at the inside diameter of a front part of the container body 104. At the same time, an inside diameter of the cartridge 102 and an outer circumference of the rotation regulating member 170 which has penetrated the shaft 153 of the push rod 150 are engaged in the form of spline, whereby the rotation regulating mechanism is constituted and also the feeding mechanism is formed.

The second embodiment is characterized in that since the rotation regulating member 170 is installed on the side of the container body 104 and the rotation regulating mechanism is constituted by spline engagement of the cartridge 102 and the rotation regulating mechanism 170, as soon as the rotation regulating mechanism constituted by spline engagement is released, a front end surface of the push rod 150 which has been pushed up by then is pushed in the opposite direction by a rear end surface of the core chuck member 120 using an urging force of the spring 103, and therefore the push rod 150 is pushed back to a location near the retreat limit while rotating with the rotation regulating member 170 along the spiral groove 143. Thus, even though the total length of the container body 104 is shortened, it is unlikely to bring about a state which a front part of the push rod 150 projects from a front end of the container body 104. Further, it will be sufficient if steps to prevent the rotation regulating member 170 from coming off and falling out of the push rod 150 are taken to the rotation regulating member 170 which the non-circular shaft 153 of the push rod 150 goes through. Further, since the push rod 150 is pushed back only by tension of the spring 103 of the cartridge 102, it is desirable that the rotation regulating member 170 is engaged only with the shaft 153 of the push rod 150 and sliding resistance against an inner circumferential surface of the container body 104 is reduced as much as possible.

Figure 10:
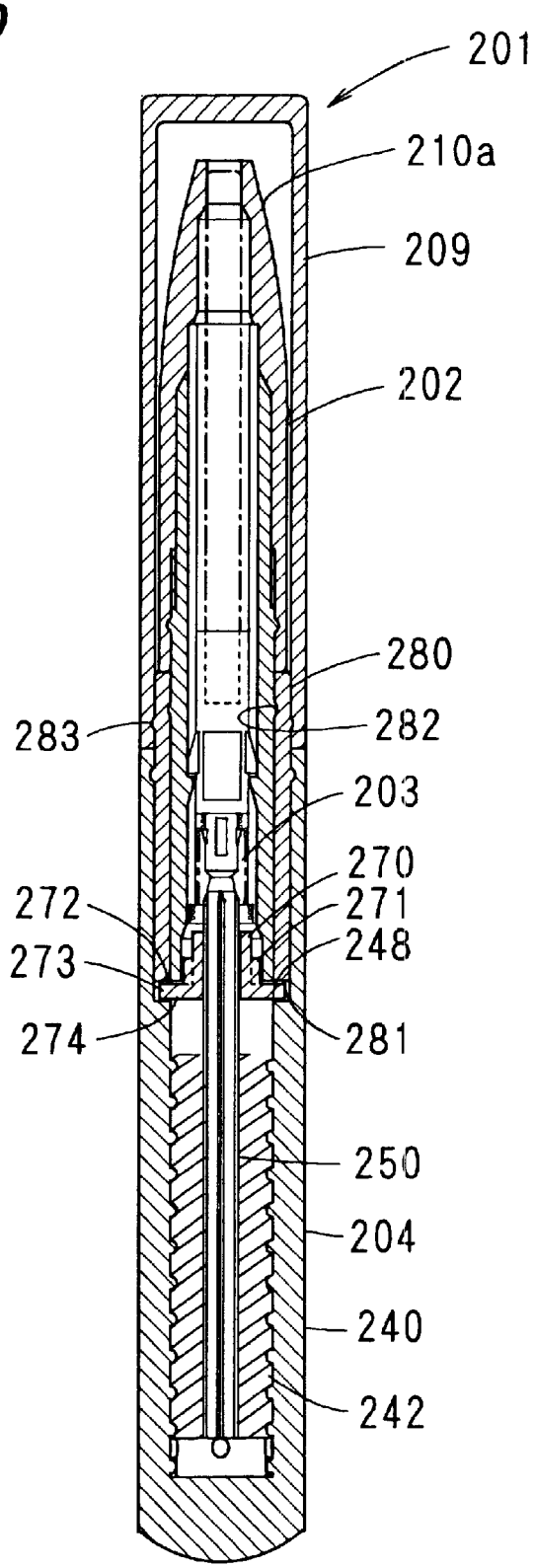
FIG. 10 is a longitudinal sectional view of a third embodiment.

FIG. 10 shows a third embodiment according to the present invention. A cartridge 202 using a spring 203 which is a helical tension spring is similar to the cartridge 102 according to the second embodiment. Also, similar to the second embodiment, a container body 204 uses a rotation regulating member 270 which a push rod 250 goes through.

The third embodiment is a cartridge type container for feeding a stick type cosmetic material 201 having a cap and its structure and method of application are actually same as those of the cartridge type container for feeding a stick type cosmetic material 101 according to the second embodiment. However, the third embodiment is characterized in that as means for preventing the rotation regulating member 270 from falling out of the container body 204, a flange section 273 of the rotation regulating member 270 loosely fits in between a lower end surface 281 of a cap engagement member 280 and an upward step section 248 provided at an inner circumference of a container body member 240.

A cap 290 is engaged with a convex section 283 which is formed at an outer circumference of the cap engagement member 280 fixed to the container body 204 in such a manner that the cap 290 can easily be attached and detached. Also, the cartridge 202 is retained by an annular convex section 282 provided at an inner circumference of the cap engagement member 280 in such a manner that the cartridge 202 can easily be attached and detached.

Figure 11:
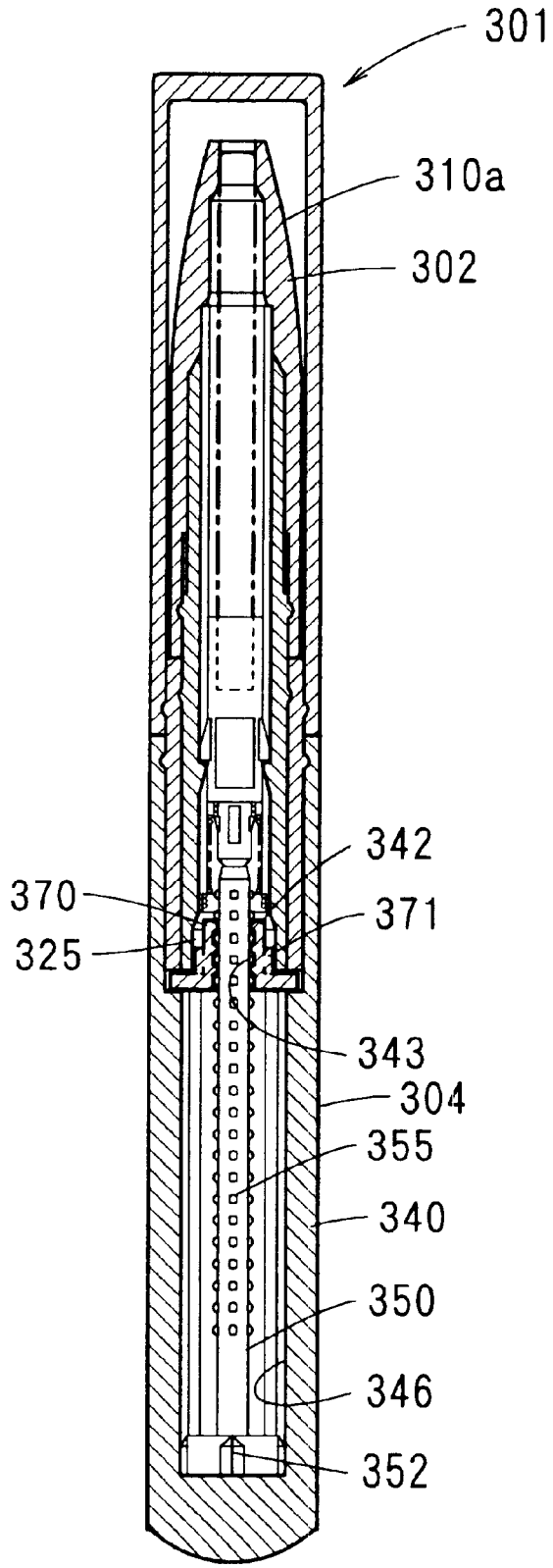
FIG. 11 is a longitudinal sectional view of a fourth embodiment.

FIG. 11 shows a fourth embodiment of the present invention.

The fourth embodiment is a cartridge type container for feeding a stick type cosmetic material 301 having a cap. Without rotating with respect to a container body 304, a push rod 350 is engaged with an engagement line section 346 of the container body 304 through a synchronous engagement section 352 provided at a lower end of the push rod 350 in such a manner that the push rod 350 can easily slide, whereby the rotation regulating mechanism is constituted.

A lot of projections which constitute a male screw section 355 are provided at the push rod 350 and spirally engaged with a female screw section 342 of a spiral engagement section 370, whereby the spiral engagement mechanism is constituted. The spiral engagement member 370 is retained between a container body member 340 and a cap engagement member 380 in such a manner that the spiral engagement member 370 can freely rotate, but cannot fall out.

When a cartridge 302 is attached to the container body 304, the spiral engagement member 370 and the cartridge 302 are engaged unrotatably to each other due to engagement of a spline 325 and a vertical rib 371, whereby a feeding mechanism for feeding out the push rod 350 is formed.

In this state, by rotating an exposed section 310*a* of the cartridge 302 and the container body 304 relatively to each other with the exposed section 310*a* being held, the push rod 350 moves due to spiral engagement, whereby a stick type cosmetic material retained at a core chuck 321 can be pushed out.

Further, since the spiral engagement member 370 can freely rotate during the period till the cartridge 302 is completely attached to the container body 304, namely, before the feeding mechanism is formed, when a rear end of the core chuck 321 pushes the push rod 350, the push rod 350 retreats while the spiral engagement member 370 is rotated.

When the cartridge 302 is attached to the container body 304 in such a manner, there will be no such a case that the core chuck 321 is pushed out by the push rod 350 and the stick type cosmetic material comes out.

The structure of the cartridge and holder side according to the present invention is not restricted to the structure of the cartridge 2 and the container body 4 according to the first embodiment and the structure of the cartridge 102 and the container body 104 according to the second embodiment. Even though a core chuck member retained in a cartridge is always urged backward by an urging force of a spring, a rotation regulating mechanism is provided for synchronously rotating the container body member and the push rod, and when the cartridge is attached to a container body, the push rod in the container body moves in an axial direction due to rotations of the cartridge and the container body, it can be adopted regardless of its mechanism, as long as a rear end surface of the core chuck member in the cartridge is pushed, the core chuck member moves in an axial direction against the urging force of the spring, and a stick type cosmetic material retained by the core chuck member advances or retreats through a front end opening hole of the cartridge. This enables the prevention of an accident, such as breaking which may occur resulting from inadvertently pushing out the stick type cosmetic material at the time of insertion of a new cartridge, by utilizing a resiliency of the spring which urges a core chuck backward in the cartridge.

Further, the cartridge is attached to the container body in such a manner that the cartridge and the container body are rotatably retained. When the stick type cosmetic material is fed out, due to the urging force of the spring in the cartridge, a load is applied to the retained part resulting from preventing the cartridge from springing out of the container body. Thus, there is an expectation that the push rod can come to a standstill in a state of already advanced only by rotary resistance which arises resulting from the load. However, if it is desired to have the sensation of solidity in handling by giving weight to feeding slide, it will be justifiable that a resistance member, such as an O-ring or a leaf spring, is applied to a part which slides when the cartridge and the container body rotate.

It is obvious that the present invention is not restricted to the embodiments described above and various modifications can be made within a scope of technical idea of the present invention.

What is claimed is:

1. A cartridge type container for feeding a stick type cosmetic material, comprising:

a container body;

a cartridge which is freely attachable and detachable to a front end of the container body, the cartridge having an exposed section that is disposed outside of the container body when the cartridge is fully attached to the container body;

a core chuck member disposed in the cartridge, and being adapted to retain the stick type cosmetic material, said core chuck member being slidable in the cartridge in a first direction to advance the stick type cosmetic material from the cartridge, and being slidable in the cartridge in a second direction that is opposite to the first direction to retract the stick type cosmetic material into the cartridge;

a spring positioned to constantly urge the core chuck member in the second direction;

a push rod disposed in the container body and being engageable with the core chuck member; and a feeding mechanism which is formed only when the cartridge is fully attached to the container body, and which causes the push rod to move in the first direction and the second direction due to rotations of the exposed section of the cartridge relative to the container body, wherein when the cartridge is attached to the container body, and prior to the feeding mechanism being formed, the push rod is moved in the second direction by pushing a tip of the push rod against a rear end surface of the core chuck member, while the spring prevents the core chuck member from moving in the cartridge in the first direction.

2. The cartridge type container recited in claim 1 wherein the feeding mechanism comprises:

a spiral engagement mechanism that includes a female screw section formed in the container body, and a male screw section formed on the push rod, the male screw section being spirally engaged with the female screw section; and a rotation regulating mechanism which is formed when the cartridge is attached to the container body, and which causes the exposed section of the cartridge and the push rod to synchronously rotate.

3. The cartridge type container recited in claim 2 wherein the cartridge has an engagement line section formed on an inner circumferential surface thereof, and wherein the push rod has a synchronous engagement section formed at a tip thereof, the rotation regulating mechanism being formed by engaging the engagement line section with the synchronous engagement section.

4. The cartridge type container recited in claim 2 further comprising a rotation regulating member which is arranged in the container body so that it cannot fall out, the push rod penetrating the rotation regulating member, the push rod and the rotation regulating member being synchronously rotatable, the rotation regulating member having a rib, and the cartridge having a spline that engages the rib to form the rotation regulating mechanism.

5. The cartridge type container recited in claim 4 wherein when the cartridge is removed from the container body, the spline disengages the rib, and the push rod is pushed in a direction of a retreat limit in the container body by a rear end surface of the core chuck member.

6. The cartridge type container recited in claim 1 wherein the container body includes a container body member, and wherein the feeding mechanism comprises:

a rotation regulating mechanism that causes the push rod and the container body member to synchronously rotate;

a spiral engagement member which is spirally engaged with the push rod;

a rib formed at the spiral engagement member; and a spline formed in the cartridge;

and wherein when the cartridge is fully attached to the container body, the rib and the spline engage each other to form the feeding mechanism.

7. The cartridge type container recited in claim 6 wherein when the cartridge is removed from the container body, the rib and the spline disengage each other, and the push rod is pushed in a direction of a retreat limit in the container body by a rear end surface of the core chuck member.

* * * * *